US009709920B2

(12) United States Patent
Aikawa

(10) Patent No.: US 9,709,920 B2
(45) Date of Patent: Jul. 18, 2017

(54) SENSOR, METHOD OF DETECTING MAGNETIC SUBSTANCE, AND IMAGE FORMING APPARATUS

(71) Applicant: KYOCERA Document Solutions Inc., Osaka (JP)

(72) Inventor: Yukihiro Aikawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/078,689

(22) Filed: Mar. 23, 2016

(65) Prior Publication Data

US 2016/0282306 A1 Sep. 29, 2016

(30) Foreign Application Priority Data

Mar. 27, 2015 (JP) ..... 2015-067541

(51) Int. Cl.
*G03G 15/08* (2006.01)

(52) U.S. Cl.
CPC ..... *G03G 15/0829* (2013.01); *G03G 15/0848* (2013.01); *G03G 2215/0614* (2013.01)

(58) Field of Classification Search
CPC ..... G03G 15/0829
USPC ..... 399/61
See application file for complete search history.

(56) References Cited

U.S. PATENT DOCUMENTS

2005/0151081 A1* 7/2005 Hjertman ..... A61M 5/145 250/336.1
2014/0097836 A1 4/2014 Aikawa ..... 324/258
2014/0103922 A1* 4/2014 Morimoto ..... G01N 27/72 324/258

FOREIGN PATENT DOCUMENTS

JP 2000066502 A * 3/2000
JP 2002116596 A * 4/2002
JP 2013096830 A * 5/2013
JP 2014-74638 A 4/2014

OTHER PUBLICATIONS

Computer translation of JP2000-066502A to Kawase et al., Mar. 2000.*

* cited by examiner

*Primary Examiner* — Quana M Grainger
(74) *Attorney, Agent, or Firm* — Stein IP, LLC

(57) ABSTRACT

The sensitivity of a sensor that detects the amount or density of magnetic substance is raised. The sensor includes an oscillation circuit, a differential transformer, and an amplification circuit. The oscillation circuit includes a resonance circuit having a coil. The differential transformer includes the coil, as a primary coil, and a secondary coil, and is configured such that, as the amount or density of magnetic substance as a detection target increases, a signal output from the secondary coil increases, and as the amount or density of magnetic substance decreases, the signal decreases. The amplification circuit amplifies the signal, and has, as its frequency characteristics, a frequency band such that, as the frequency of the signal decreases, the amplification factor of the signal increases, and as the frequency of the signal increases, the amplification factor of the signal decreases. The resonance frequency of the resonance circuit falls within the frequency band.

8 Claims, 5 Drawing Sheets

FIG.3

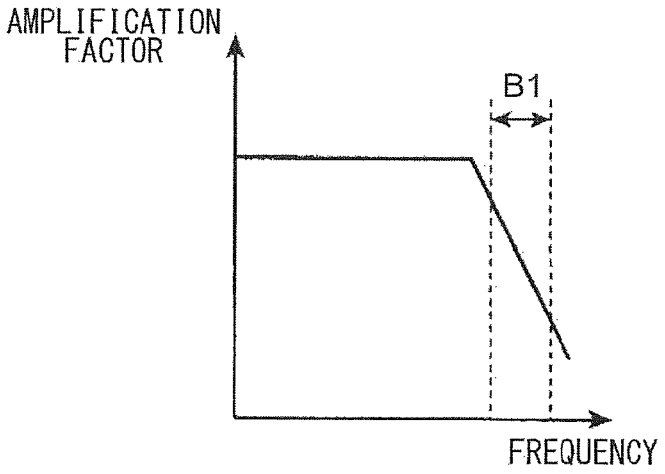

FIG.4

| OSCILLATION CIRCUIT | | DIFFERENTIAL TRANSFORMER | | AMPLIFICATION CIRCUIT | |
|---|---|---|---|---|---|
| AMOUNT OR DENSITY OF MAGNETIC SUBSTANCE | OSCILLATION FREQUENCY OF OSCILLATION CIRCUIT | AMOUNT OR DENSITY OF MAGNETIC SUBSTANCE | AMPLITUDE OF SIGNAL S1 | FREQUENCY OF SIGNAL S1 | AMPLIFICATION FACTOR |
| DECREASE | INCREASE | DECREASE | DECREASE | INCREASE | DECREASE |
| INCREASE | DECREASE | INCREASE | INCREASE | DECREASE | INCREASE |

OSCILLATION FREQUENCY OF OSCILATION CIRCUIT ≒ FREQUENCY OF SIGNAL S1

FIG.7

--Prior Art--

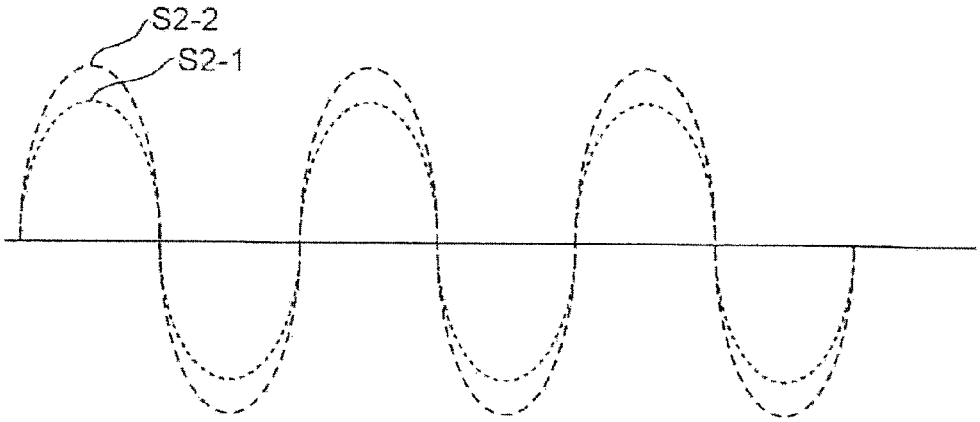

FIG.8

| OSCILLATION CIRCUIT | | DIFFERENTIAL TRANSFORMER | | AMPLIFICATION CIRCUIT | |
|---|---|---|---|---|---|
| AMOUNT OR DENSITY OF MAGNETIC SUBSTANCE | OSCILLATION FREQUENCY OF OSCILLATION CIRCUIT | AMOUNT OR DENSITY OF MAGNETIC SUBSTANCE | AMPLITUDE OF SIGNAL S1 | FREQUENCY OF SIGNAL S1 | AMPLIFICATION FACTOR |
| DECREASE | INCREASE | DECREASE | INCREASE | INCREASE | INCREASE |
| INCREASE | DECREASE | INCREASE | DECREASE | DECREASE | DECREASE |

OSCILLATION FREQUENCY OF OSCILATION CIRCUIT ≒ FREQUENCY OF SIGNAL S1

SENSOR, METHOD OF DETECTING MAGNETIC SUBSTANCE, AND IMAGE FORMING APPARATUS

INCORPORATION BY REFERENCE

This application is based upon and claims the benefit of priority from the corresponding Japanese Patent Application No. 2015-067541 filed on Mar. 27, 2015, the entire contents of which are incorporated herein by reference.

BACKGROUND

The present disclosure relates to a sensor that detects the amount or density of magnetic substance.

Some image forming apparatuses that use toner as developer adopt a system using one-component developer comprising toner containing magnetic substance (toner containing several percent of magnetic substance), while other image forming apparatuses adopt a system using two-component developer comprising non-magnetic toner and magnetic carrier. For the purpose of, with one-component developer, detecting the amount of toner and, with two-component developer, detecting the density of toner, a sensor that detects the amount or density of magnetic substance is used.

There is conventionally known, for example, a sensor that detects the amount or density of magnetic substance by use of a differential transformer.

It is occasionally necessary to detect a slight change in the amount or density of magnetic substance. For example, with one-component developer, as toner is fed to an electrostatic latent image, the amount of toner in a developing portion decreases, and new toner is supplied to the developing portion. It is necessary to keep the amount of toner in the developing portion constant so as to obtain a proper image. It is necessary to control the amount of toner by detecting a slight change in the amount of toner so as to obtain a high-quality image.

To detect a slight change in the amount or density of magnetic substance, the sensitivity of a sensor needs to be raised.

SUMMARY

According to a first aspect of the present disclosure, a sensor includes an oscillation circuit, a differential transformer, and an amplification portion. The oscillation circuit includes a resonance circuit having a coil. The differential transformer includes the coil, as a primary coil, and a secondary coil, and is configured such that, as the amount or density of magnetic substance as a detection target increases, a signal output from the secondary coil increases, and as the amount or density of magnetic substance decreases, the signal decreases. The amplification portion amplifies the signal, and has, as its frequency characteristics, a frequency band such that, as the frequency of the signal decreases, the amplification factor of the signal increases, and as the frequency of the signal increases, the amplification factor of the signal decreases. The resonance frequency of the resonance circuit falls within the frequency band.

According to a second aspect of the present disclosure, a sensor includes an oscillation circuit, a differential transformer, and an amplification portion. The oscillation circuit includes a resonance circuit having a coil. The differential transformer includes the coil, as a primary coil, and a secondary coil, and is configured such that, as the amount or density of magnetic substance as a detection target decreases, a signal output from the secondary coil increases, and as the amount or density of magnetic substance increases, the signal decreases. The amplification portion amplifies the signal, and has, as its frequency characteristics, a frequency band such that, as the frequency of the signal decreases, the amplification factor of the signal decreases, and as the frequency of the signal increases, the amplification factor of the signal increases. The resonance frequency of the resonance circuit falls within the frequency band.

According to a third aspect of the present disclosure, an image forming apparatus includes a developing portion for forming a toner image by feeding toner to an electrostatic latent image and a sensor as described above for measuring the amount or density of toner in the developing portion.

According to a fourth aspect of the present disclosure, a method of detecting magnetic substance includes providing a sensor configured as described above and measuring the amount or density of toner in the developing portion which forms a toner image by feeding toner to an electrostatic latent image.

BRIEF DESCRIPTION OF THE DRAWINGS

FIG. 3 is a graph showing frequency characteristics of an amplification circuit provided in a sensor according to the first embodiment;

FIG. 4 is a table illustrating the relationship among an oscillation circuit, a differential transformer, and an amplification circuit in the first embodiment;

FIG. 7 graphically represents a signal S2-1, which is a signal S2 generated when the amount or density of magnetic substance present near a coil L3 is small, and a signal S2-2, which is the signal S2 generated when the amount or density of magnetic substance present near the coil L3 is large in a comparative example;

FIG. 8 is a table explaining the relationship among an oscillation circuit, a differential transformer, and an amplification circuit in the second embodiment;

DETAILED DESCRIPTION

Figure 1:
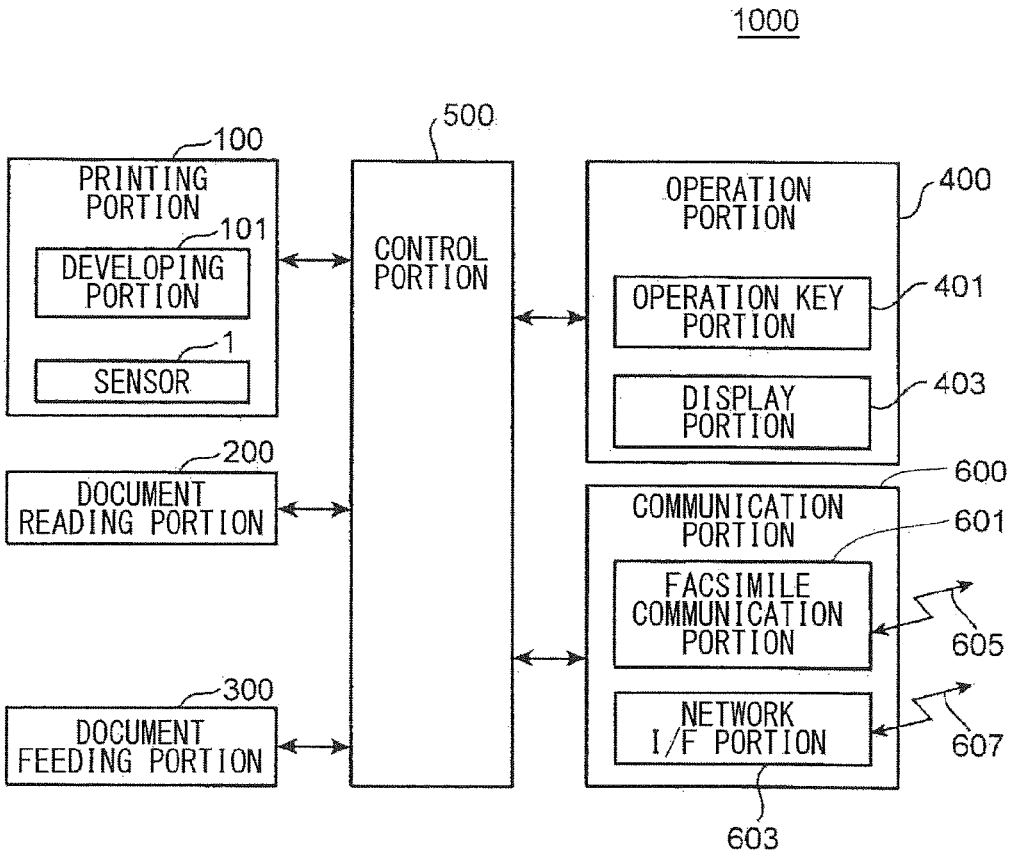
FIG. 1 is a block diagram showing the configuration of an image forming apparatus provided with a sensor according to a first and a second embodiment of the present disclosure.

Hereinafter, embodiments of the present disclosure will be described in detail with reference to the accompanying drawings. FIG. 1 is a block diagram showing the configuration of an image forming apparatus 1000 provided with a sensor 1 according to a first and a second embodiment of the present disclosure. As an example of the image forming apparatus 1000, the following description deals with a digital multifunction peripheral having the functions of a copier, a printer, a scanner, and a facsimile machine. The image forming apparatus 1000 can be any device that has the capability of printing images, and is thus not limited to a digital multifunction peripheral. For example, the image forming apparatus 1000 may instead be a printer. The image forming apparatus 1000 includes a printing portion 100, a document reading portion 200, a document feeding portion 300, an operation portion 400, a control portion 500, and a communication portion 600.

When a document comprising a single sheet is placed on a document placement portion provided in the document feeding portion 300, the document feeding portion 300 feeds the document to the document reading portion 200. When a document comprising a plurality of sheets is placed on the document placement portion, the document feeding portion 300 feeds the document to the document reading portion 200 continuously.

The document reading portion 200 reads a document placed on a document stage or a document fed from the document feeding portion 300, and outputs the image data of the document.

The printing portion 100 prints on a sheet of a recording medium an image conveyed by print data transmitted from a personal computer (unillustrated), an image conveyed by image data fed from the document reading portion 200, or an image conveyed by received facsimile data.

The printing portion 100 is provided with a developing portion 101. The developing portion 101 feeds toner to an electrostatic latent image formed based on the print data, the image data, or the facsimile data. Thereby, a toner image is formed as a basis for the above-mentioned image.

When the image forming apparatus 1000 adopts an one-component developing system, the sensor 1 detects the amount of toner inside the developing portion 101. When the image forming apparatus 1000 adopts a two-component developing system, the sensor 1 detects the density of toner inside the developing portion 101.

The operating portion 400 is provided with an operation key portion 401 and a display portion 403. The display portion 403 has a touch-panel function, and displays a screen that includes software keys. A user operates the software keys while viewing the screen to make settings necessary to execute copying and other functions.

The operation key portion 401 is provided with operation keys comprising hardware keys. The operation keys include, for example, a Start key, a numeric keypad, a Reset key, and function switching keys for switching among the functions of a copier, a printer, a scanner, and a facsimile machine.

The control portion 500 is provided with a CPU, a ROM, and a RAM. The CPU performs, with respect to the above-described components (for example, the printing portion 100) of the image forming apparatus 1000, control that is necessary to make the image forming apparatus 1000 operate. The ROM stores software necessary to control the operation of the image forming apparatus 1000. The RAM is used for temporarily storing data generated during execution of software, for storing application software, and so forth.

The communication portion 600 is provided with a facsimile communication portion 601 and a network I/F portion 603. The facsimile communication portion 601 is provided with an NCU (network control unit) which controls the connection of a telephone line to a destination facsimile machine, and with a modulation/demodulation circuit which modulates and demodulates a facsimile communication signal. The facsimile communication portion 601 is connected to a telephone line 605.

The network I/F portion 603 is connected to an LAN (local area network) 607. The network I/F portion 603 is a communication interface circuit for performing communication with a client device connected to the LAN 607.

Figure 2:
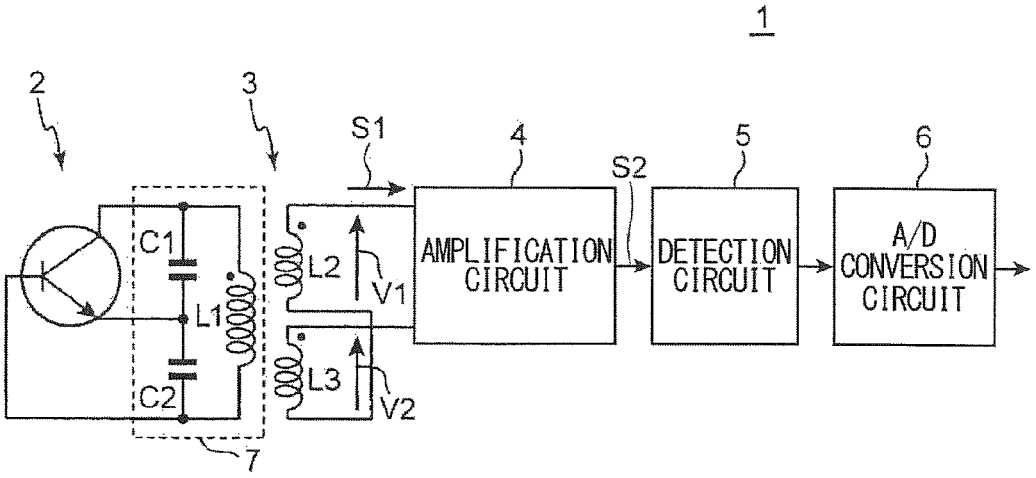
FIG. 2 is a block diagram showing the configuration of a sensor according to the first and second embodiments.

FIG. 2 is a block diagram showing a configuration of the sensor 1 according to the first and second embodiments of the present disclosure. The sensor 1 includes an oscillation circuit 2, a differential transformer 3, an amplification circuit 4, a detection circuit 5, and an A/D conversion circuit 6.

The oscillation circuit 2 is a Colpitts oscillating circuit provided with an amplifier that includes a transistor, and with a resonance circuit 7 that includes a capacitor C1, a capacitor C2, and a coil L1.

The differential transformer 3 is provided with a primary coil composed of the coil L1, and with a secondary coil composed of a coil L2 and a coil L3. The coil L1 functions as a driving coil. Through the coil L1, a high-frequency driving current generated by the oscillation circuit 2 passes. The black dots in FIG. 2 indicate the polarity of the coils.

The coil L2 functions as a reference coil, and the coil L3 functions as a detection coil. The coil L2 and the coil L3 are differentially connected in series. In other words, the coil L2 and the coil L3 are electrically connected together such that the directions of the induction currents that pass through the coil L2 and the coil L3 respectively are opposite from each other. Thus, a differential voltage (the electromotive voltage V1 in the coil L2 minus the electromotive voltage V2 in the coil L3) is generated. The differential voltage output from the differential transformer 3 as a signal S1.

The amplification circuit 4 is a circuit for amplifying an AC signal, and generates a signal S2 by amplifying the signal S1. The detection circuit 5 converts the signal S2 into a DC signal. The A/D conversion circuit 6 converts this DC signal into a digital signal. The control portion 500 in FIG. 1 calculates the amount or density of toner based on this digital signal.

First Embodiment

The differential transformer 3 is configured such that, when there is no magnetic substance around the coil L3 (detection coil) (that is, when no magnetic substance is being detected by the coil L3), the differential voltage (signal S1) is substantially equal to zero volts. When the high-frequency driving voltage generated by the oscillation circuit 2 passes through the coil L1, an electromotive voltage V1 occurs in the coil L2, and an electromotive voltage V2 occurs in the coil L3. When there is magnetic substance near the coil L3 (that is, when magnetic substance is being detected by the coil L3), the electromotive voltage V2 is higher than the electromotive voltage V1, and thus the differential voltage does not equal zero V. As the amount or density of the magnetic substance present near the coil L3 increases, the amplitude of the differential voltage increases (the signal S1 increases), and as the amount or density of the magnetic substance present near the coil L3 decreases, the amplitude of the differential voltage decreases (the signal S1 decreases). Relying on this behavior, the sensor 1 detects the amount or density of magnetic substance.

The amplification circuit 4 has frequency characteristics as shown in FIG. 3. That is, the amplification circuit 4 has, as its frequency characteristics, a frequency band B1 such that, as the frequency of the signal S1 decreases, the amplification factor of the signal S1 increases, and as the frequency of the signal S1 increases, the amplification factor of the signal S1 decreases. Thus, the amplification circuit 4 functions as a low-pass filter (cuffing off high-frequency components).

At least one of the resonance circuit 7 and the amplification circuit 4 is configured such that, both with and without a magnetic substance present near the coil L3 (that is, both with and without a magnetic substance being detected by the coil L3), the resonance frequency of the resonance circuit 7 falls within the frequency band B1. This results in the relationship shown in FIG. 4.

FIG. 4 is a table illustrating the relationship among the oscillation circuit 2, the differential transformer 3, and the amplification circuit 4 in the first embodiment. As shown in FIG. 2, the coil L1 (driving coil) and the coil L2 (reference coil) are arranged close to the coil L3 (detection coil), and thus, when there is magnetic substance near the coil L3, they are affected by the magnetic substance. This causes change in the self-inductances and mutual inductances of the coil L1, the coil L2, and the coil L3.

With increasing closeness to the magnetic substance, that is, in the order L2, L1, L3, the coils are affected more by the magnetic substance. The self-inductance of the coil L1 increases by being affected by the magnetic substance. Thus, the resonance frequency of the resonance circuit 7 (that is, the oscillation frequency of the oscillation circuit 2) decreases. Accordingly, as the amount or density of the magnetic substance present near the coil L3 (hereinafter, referred to simply as "the amount or density of the magnetic substance") decreases, the resonance frequency of the resonance circuit 7 increases, and as the amount or density of the magnetic substance increases, the resonance frequency of the resonance circuit 7 decreases.

As described above, when magnetic substance is detected by whichever of the primary coil and the secondary coil detects magnetic substance (that is, when there is magnetic substance near that coil), the primary coil is also affected by the magnetic substance, and its inductance changes. The primary coil is composed of the coil L1 in the resonance circuit 7, and thus as its inductance changes, the resonance frequency of the resonance circuit 7 (the oscillation frequency of the oscillation circuit 2) changes.

As described previously, the differential transformer 3 is configured such that, as the amount or density of magnetic substance decreases, the amplitude of the signal S1 output from the differential transformer 3 decreases, and as the amount or density of the magnetic substance increases, the amplitude of the signal S1 increases. Here, a decrease in the amplitude of the signal S1 means a decrease in the signal S1, and an increase in the amplitude of the signal S1 means an increase in the signal S1.

As described with reference to FIG. 3, in the amplification circuit 4, as the frequency of the signal S1 increases, the amplification factor of the amplification circuit 4 decreases, and as the frequency of the signal S1 decreases, the amplification factor of the amplification circuit 4 increases. The resonance frequency of the resonance circuit 7 is substantially equal to the oscillation frequency of the oscillation circuit 2, and accordingly the frequency of the signal S1 is substantially equal to the resonance frequency.

To summarize, as the amount or density of magnetic substance decreases, the amplitude of the signal S1 decreases, and the amplification factor of the amplification circuit 4 also decreases. In contrast, as the amount or density of magnetic substance increases, the amplitude of the signal S1 increases, and the amplification factor of the amplification circuit 4 also increases.

Figure 5:
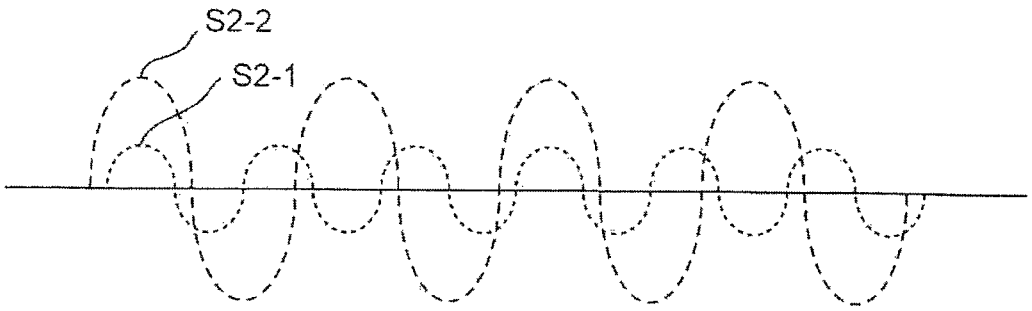
FIG. 5 graphically represents a signal S2-1, which is a signal S2 generated when the amount or density of magnetic substance present near a coil L3 is small, and a signal S2-2, which is the signal S2 generated when the amount or density of magnetic substance present near the coil L3 is large in the first embodiment.
Figure 6:
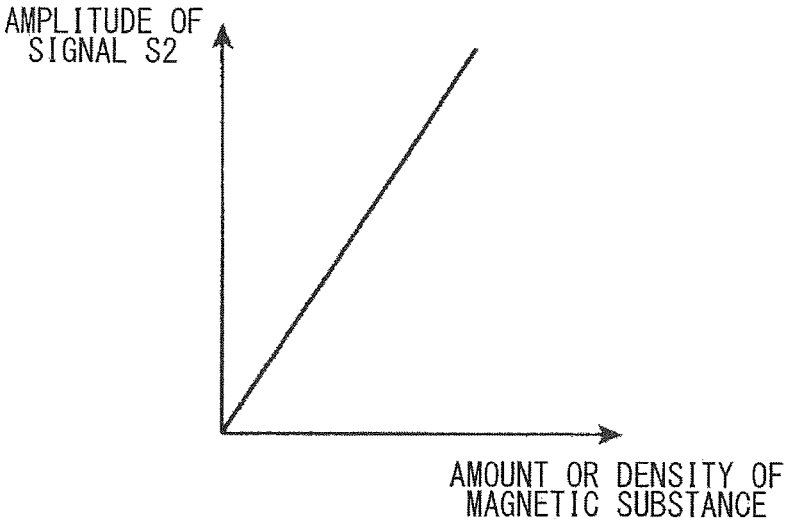
FIG. 6 is a graph representing the relationship between a signal S2 and the amount or density of magnetic substance in the first embodiment.

As a result, the signal S2 fed out from the amplification circuit 4 changes comparatively greatly in response to a slight change in the amount or density of magnetic substance. This is graphically explained in FIG. 5. Let the signal S2 generated when the amount or density of magnetic substance is small be a signal S2-1, and let the signal S2 generated when the amount or density of magnetic substance is large be a signal S2-2. The difference between the amplitude of the signal S2-1 and the amplitude of the signal S2-2 is relatively large, and thus, as the amount or density of magnetic substance slightly changes, the amplitude of the signal S2 greatly changes. This is graphically represented in FIG. 6. The horizontal axis represents the amount or density of magnetic substance, and the vertical axis represents the amplitude of the signal S2. As shown in FIG. 6, the gradient is steep. This indicates that a slight change in the amount or density of magnetic substance is detectable. That is, this embodiment can be said to disclose a method of detecting magnetic substance which allows satisfactory detection of the amount or density of magnetic substance.

FIG. 7 shows a case of a comparative example in which the resonance frequency of the resonance circuit 7 is configured to fall within the flat band shown in FIG. 3. In the comparative example, the amplification factor of the signal S2-1 is equal to the amplification factor of the signal S2-2, and thus the difference between the amplitude of the signal S2-1 and the amplitude of the signal S2-2 is relatively small. Thus, in the first embodiment, the sensitivity of the sensor can be raised as compared with that in the comparative example.

In the first embodiment, the amplification circuit 4 shown in FIG. 2 has as its frequency characteristics the frequency band B1 shown in FIG. 3. Instead of giving the amplification circuit 4 such frequency characteristics, it is also possible to adopt a configuration where a low-pass filter is arranged at a stage either preceding or succeeding the amplification circuit 4. In this configuration, at least one of the resonance circuit 7 and the low-pass filter is configured such that, both with and without a magnetic substance present near the coil L3 (that is, both with and without a magnetic substance being detected by the coil L3), the resonance frequency of the resonance circuit 7 falls within a frequency band higher than the cutting-off frequency of the low-pass filter.

In this configuration, the combination of the low-pass filter and the amplification circuit 4 functions as the amplification circuit 4 (amplification portion) of the sensor 1 according to the first embodiment. According to this configuration, for the same reason as with the sensor 1 according to the first embodiment, the sensitivity of the sensor can be raised.

Second Embodiment

The second embodiment will be described with focus placed on differences from the first embodiment. A block diagram that shows the configuration of a sensor 1 according to the second embodiment is the same as the block diagram that shows the configuration of the sensor 1 according to the first embodiment, and is shown in FIG. 2. FIG. 8 is a table explaining the relationship among the oscillation circuit 2, the differential transformer 3, and the amplification circuit 4 in the second embodiment.

In the second embodiment, the differential transformer 3 is configured such that, when the amount of magnetic substance present near the coil L3 is largest (for example, when the developing portion 101 shown in FIG. 1 is full with toner), the differential voltage (signal S1) is substantially equal to zero volts. One way to achieve that is, in a configuration where the coils L1, L2, and L3 of the differential transformer 3 are three-dimensional coils, to move the movable iron core of the differential transformer 3 toward the coil L2 (reference coil) to make the electromotive voltage V1 generated in the coil L2 higher than the electromotive voltage V2 generated in the coil L3 (detection coil). Another way is, in a configuration where the coils L1, L2, and L3 of the differential transformer 3 are two-dimensional coils, to give a larger number of turns to the coil L2 (reference coil) than to the coil L3 (detection coil) to make the electromotive voltage V1 generated in the coil L2 higher than the electromotive voltage V2 generated in the coil L3.

With this configuration, in the differential transformer 3 according to the second embodiment, as distinct from the differential transformer 3 according to the first embodiment, as the amount or density of magnetic substance which is a detection target decreases, the amplitude of the signal S1 output from the differential transformer 3 increases, and as the amount or density of magnet substance increases, the amplitude of the signal S1 decreases.

Figure 9:
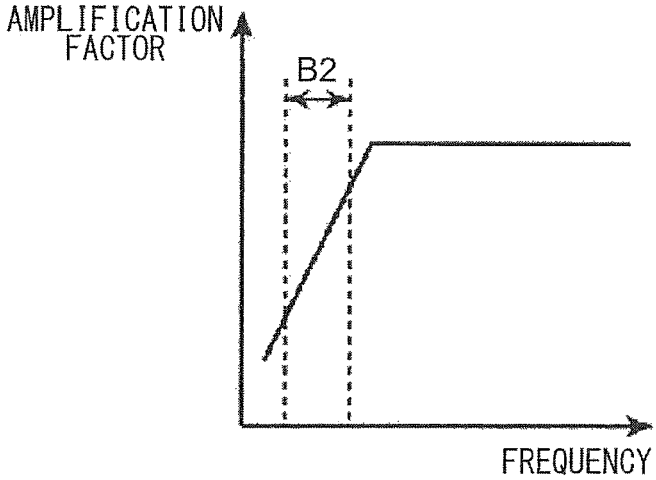
FIG. 9 is a graph showing frequency characteristics of an amplification circuit provided in a sensor according to the second embodiment.

The amplification circuit 4 according to the second embodiment, as distinct from the amplification circuit 4 according to the first embodiment, has frequency characteristics as shown in FIG. 9. That is, the amplification circuit 4 has, as its frequency characteristics, a frequency band B2 such that, as the frequency of the signal S1 decreases, the amplification factor of the signal S1 decreases, and as the frequency of the signal S1 increases, the amplification factor of the signal S1 increases. Thus, the amplification circuit 4 according to the second embodiment functions as a high-pass filter (cutting off low-frequency components).

Figure 10:
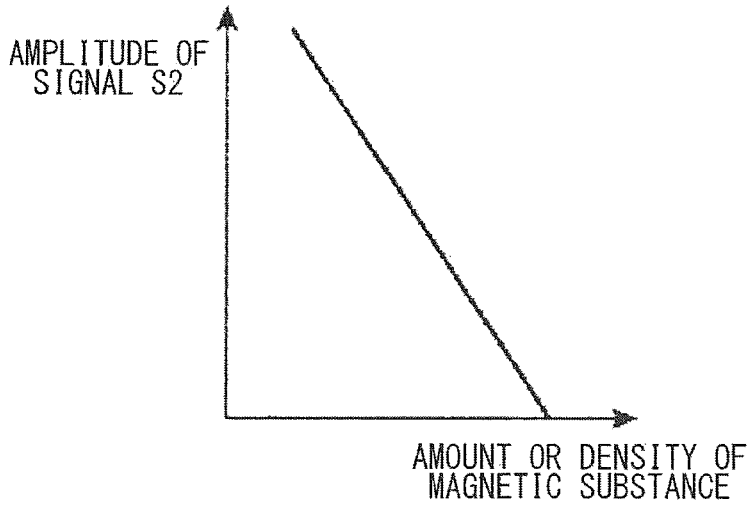
FIG. 10 is a graph representing the relationship between a signal S2 and the amount or density of magnetic substance in the second embodiment.

At least one of the resonance circuit 7 and the amplification circuit 4 is configured such that, both with and without a magnetic substance present near the coil L3 (that is, both with and without a magnetic substance being detected by the coil L3), the resonance frequency of the resonance circuit 7 falls within the frequency band B2. As a result, as in the first embodiment, the signal S2 fed out from the amplification circuit 4 changes comparatively greatly in response to a slight change in the amount or density of magnetic substance. This is graphically shown in FIG. 10. The horizontal axis represents the amount or density of magnetic substance, and the vertical axis represents the amplitude of the signal S2. As shown in FIG. 10, the gradient is steep. This indicates that a slight change in the amount or density of magnetic substance is detectable. Thus, in the second embodiment, the sensitivity of the sensor can be raised. That is, this embodiment also can be said to disclose a method of detecting magnetic substance which allows satisfactory detection of the amount or density of magnetic substance.

In the second embodiment, the amplification circuit 4 shown in FIG. 2 has as its frequency characteristics the frequency band B2 shown in FIG. 9. Instead of giving the amplification circuit 4 such frequency characteristics, it is also possible to adopt a configuration where a high-pass filter is arranged at a stage either preceding or succeeding the amplification circuit 4. In this configuration, at least one of the resonance circuit 7 and the high-pass filter is configured such that, both with and without a magnetic substance present near the coil L3 (that is, both with and without a magnetic substance being detected by the coil L3), the resonance frequency of the resonance circuit 7 falls within a frequency band lower than the culling-off frequency of the high-pass filter.

In this configuration, the combination of the high-pass filter and the amplification circuit 4 functions as the amplification circuit 4 (amplification portion) of the sensor 1 according to the second embodiment. According to this configuration, for the same reason as with the sensor 1 according to the second embodiment, the sensitivity of the sensor can be raised.

Other Embodiments: Modified Examples

Figure 11:
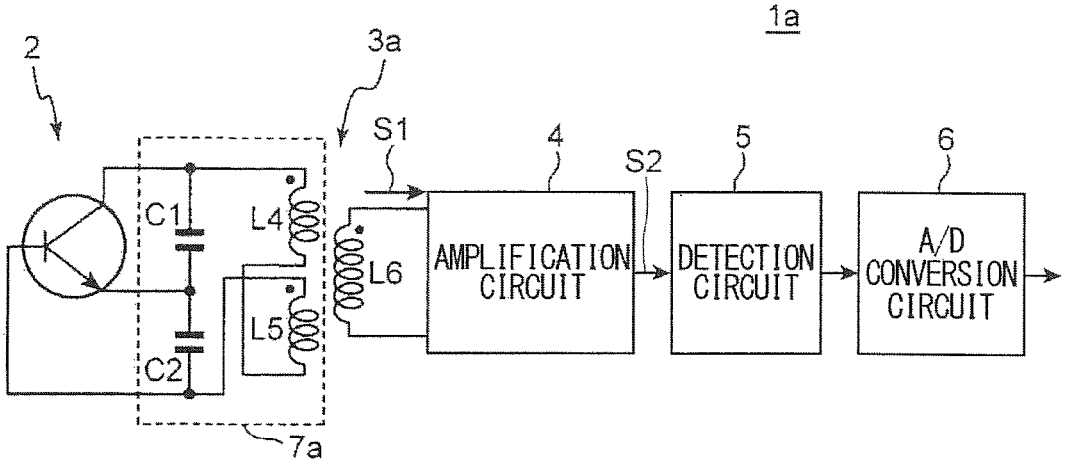
FIG. 11 is a block diagram showing the configuration of a sensor according to a modified example of the first and second embodiments.

Modified examples of the first and second embodiments will be described. FIG. 11 is a block diagram showing the configuration of a sensor 1*a* according to a modified example. The sensor 1*a* differs from the sensor 1 shown in FIG. 2 in the configuration of a differential transformer 3*a* and a resonance circuit 7*a*. The differential transformer 3*a* includes a primary coil composed of a coil L4 and a coil L5, and a secondary coil composed of a coil L6.

The coil L4 functions as both a reference coil and a driving coil, and the coil L5 functions as both a detection coil and a driving coil. The coil L4 and the coil L5 are differentially connected in series. The black dots in FIG. 11 indicate the polarity of the coils.

The resonance circuit 7*a* includes a capacitor C1, a capacitor C2, the coil L4, and the coil L5.

With the sensor 1*a* according to the modified example, for the same reason as with the sensor according to the first and second embodiments, the sensitivity of the sensor can be raised.

As described earlier, according to a first aspect of the present disclosure, a sensor 1 includes an oscillation circuit 2 including a resonance circuit 7 having a coil, and a differential transformer 3 including the coil as a primary coil. The differential transformer 3 further includes a secondary coil, and is configured such that, as the amount or density of magnetic substance as a detection target increases, a signal S1 output from the secondary coil increases, and as the amount or density of magnetic substance decreases, the signal S1 decreases. The sensor also includes an amplification portion (amplification circuit 4) for amplifying the signal S1. The amplification portion has, as its frequency characteristics, a frequency band B1 such that, as the frequency of the signal S1 decreases, the amplification factor of the signal S1 increases, and as the frequency of the signal S1 increases, the amplification factor of the signal S1 decreases. The resonance frequency of the resonance circuit 7 falls within the frequency band B1.

When magnetic substance is detected by whichever of the primary coil and the secondary coil detects magnetic substance (that is, when there is magnetic substance near that coil), the primary coil is also affected by the magnetic substance, and its inductance changes. The primary coil is composed of the coil in the resonance circuit 7, and thus as its inductance changes, the resonance frequency of the resonance circuit 7 (the oscillation frequency of the oscillation circuit 2) changes. The present inventor, by focusing attention to this phenomenon, invented the sensor according to the first aspect of the first embodiment and a sensor according to a second aspect of the second embodiment of the present disclosure.

With the sensor 1 according to the first aspect of the present disclosure, as the amount or density of magnetic substance present near the coil which detects magnetic substance decreases, the signal S1 output from the differential transformer 3 decreases, and the amplification factor of the amplification portion also decreases. In contrast, as the amount or density of magnetic substance increases, the signal S1 increases, and the amplification factor of the amplification portion also increases. As a result, a signal S2 fed out from the amplification portion changes comparatively greatly in response to a slight change in the amount or density of magnetic substance. Thus, the sensitivity of the sensor 1 can be raised.

In the above-described configuration, the amplification portion includes a low-pass filter and an amplification circuit 4 for amplifying the signal S1. The amplification circuit 4 is arranged at a stage either preceding or succeeding the low-pass filter. The resonance frequency of the resonance circuit 7 falls within the frequency band B1 higher than a cutting-off frequency of the low-pass filter.

In this configuration, the combination of the low-pass filter and the amplification circuit 4 functions as the amplification portion of the sensor 1 according to the first aspect of the present disclosure. According to this configuration, for the same reason as with the sensor 1 according to the first aspect of the present disclosure, the sensitivity of the sensor can be raised. The configuration where the amplification circuit 4 is arranged at a stage either preceding or succeeding the low-pass filter is merely one example; the low-pass filter and the amplification circuit 4 do not have to be configured separately.

According to the second aspect of the present disclosure, a sensor 1 includes an oscillation circuit 2 including a resonance circuit 7 having a coil, and a differential transformer 3 including the coil as a primary coil. The differential transformer 3 further includes a secondary coil, and is configured such that, as the amount or density of magnetic substance as a detection target decreases, a signal S1 output from the secondary coil increases, and as the amount or density of magnetic substance increases, the signal S1 decreases. The sensor also includes an amplification portion for amplifying the signal S1. The amplification portion has, as its frequency characteristics, a frequency band B2 such that, as the frequency of the signal S1 decreases, the amplification factor of the signal S1 decreases, and as the frequency of the signal S1 increases, the amplification factor of the signal S1 increases. The resonance frequency of the resonance circuit 7 falls within the frequency band B2.

With the sensor 1 according to the second aspect of the present disclosure, as the amount or density of magnetic substance present near the coil which detects magnetic substance decreases, the signal S1 output from the differential transformer 3 increases, and the amplification factor of the amplification portion also increases. In contrast, as the amount or density of magnetic substance increases, the signal S1 decreases, and the amplification factor of the amplification portion also decreases. As a result, a signal S2 fed out from the amplification portion changes comparatively greatly in response to a slight change in the amount or density of magnetic substance. Thus, the sensitivity of the sensor can be raised.

In the above-described configuration, the amplification portion includes a high-pass filter and an amplification circuit 4 for amplifying the signal S1. The amplification circuit 4 is arranged at a stage either preceding or succeeding the high-pass filter. The resonance frequency of the resonance circuit 7 falls within the frequency band B2 lower than a cutting-off frequency of the high-pass filter.

In this configuration, the combination of the high-pass filter and the amplification circuit 4 functions as the amplification circuit of the sensor 1 according to the second aspect of the present disclosure. According to this configuration, for the same reason as with the sensor according to the second aspect of the present disclosure, the sensitivity of the sensor can be raised. The configuration where the amplification circuit 4 is arranged at a stage either preceding or succeeding the high-pass filter is merely one example; the high-pass filter and the amplification circuit 4 do not have to be configured separately.

According to a third aspect of the present disclosure, an image forming apparatus 1000 includes a developing portion 101 for forming a toner image by feeding toner to an electrostatic latent image and the sensor 1 for measuring the amount or density of toner in the developing portion 101. The image forming apparatus 1000 according to the present disclosure is an image forming apparatus to which the sensor 1 according to the first or the second aspect of the present disclosure is applied.

According to a fourth aspect of the present disclosure, a method of detecting magnetic substance includes providing the sensor 1 configured as described above and measuring the amount or density of toner in the developing portion 101 which forms a toner image by feeding toner to an electrostatic latent image.

As described above, according to the present disclosure, the sensitivity of a sensor that detects the amount or density of magnetic substance can be raised.

That is, according to the present disclosure, it is possible to provide a sensor having a raised sensitivity for detecting the amount or density of magnetic substance, and to provide a method of detecting magnetic substance. It is also possible to provide an image forming apparatus provided therewith.

What is claimed is:

1. A sensor comprising:

an oscillation circuit including a resonance circuit having a coil;

a differential transformer including the coil as a primary coil, the differential transformer further including a secondary coil and a movable iron core; and an amplification portion for amplifying a signal output from the secondary coil, wherein the differential transformer is configured such that, the primary coil is composed of a first coil, and the secondary coil is composed of a reference coil and a detection coil, the coils all being three-dimensional coils, the movable iron core is moved toward the reference coil, and an electromotive voltage generated in the reference coil is made higher than an electromotive voltage generated in the detection coil, and as an amount or density of magnetic substance as a detection target decreases, the signal output from the secondary coil increases, and as the amount or density of magnetic substance increases, the signal decreases, the amplification portion has, as frequency characteristics thereof, a frequency band such that, as a frequency of the signal decreases, an amplification factor of the signal decreases, and as the frequency of the signal increases, the amplification factor of the signal increases, and a resonance frequency of the resonance circuit falls within the frequency band.

2. The sensor of claim 1, wherein the amplification portion includes:

a high-pass filter; and an amplification circuit for amplifying the signal, the amplification circuit being arranged at a stage either preceding or succeeding the high-pass filter, and the resonance frequency of the resonance circuit falls within the frequency band lower than a cutting-off frequency of the high-pass filter.

3. An image forming apparatus comprising:

a developing portion for forming a toner image by feeding toner to an electrostatic latent image; and the sensor of claim 1 for measuring an amount or density of toner in the developing portion.

4. A method of detecting magnetic substance comprising;

providing the sensor of claim 1; and measuring an amount or density of toner in the developing portion which forms a toner image by feeding toner to an electrostatic latent image.

5. A sensor comprising:

an oscillation circuit including a resonance circuit having a coil;

a differential transformer including the coil as a primary coil, the differential transformer further including a secondary coil; and an amplification portion which amplifies a signal output from the secondary coil, wherein the differential transformer is configured such that, the primary coil is composed of a first coil, and the secondary coil is composed of a reference coil and a detection coil, the coils all being two-dimensional coils, a larger number of turns is given to the reference coil than to the detection coil, and an electromotive voltage generated in the reference coil is made higher than an electromotive voltage generated in the detection coil, and as an amount or density of magnetic substance as a detection target decreases, a signal leaving the secondary coil increases, and as the amount or density of magnetic substance increases, the signal decreases, the amplification portion has, as frequency characteristics thereof, a frequency band such that, as a frequency of the signal decreases, an amplification factor of the signal decreases, and as the frequency of the signal increases, the amplification factor of the signal increases, and a resonance frequency of the resonance circuit falls within the frequency band.

6. An image forming apparatus comprising:

a developing portion for forming a toner image by feeding toner to an electrostatic latent image; and the sensor of claim 5 for measuring an amount or density of toner in the developing portion.

7. A method of detecting magnetic substance comprising:

providing the sensor of claim 5; and measuring an amount or density of toner in the developing portion which forms a toner image by feeding toner to an electrostatic latent image.

8. The sensor of claim 5, wherein the amplification portion includes:

a high-pass filter; and an amplification circuit for amplifying the signal, the amplification circuit being arranged at a stage either preceding or succeeding the high-pass filter, and the resonance frequency of the resonance circuit falls within the frequency band lower than a cutting-off frequency of the high-pass filter.

* * * * *